US006779453B2

(12) United States Patent
Samii

(10) Patent No.: US 6,779,453 B2
(45) Date of Patent: Aug. 24, 2004

(54) FABRIC PRINTING SYSTEM AND METHOD UTILIZING A REMOVABLE/REUSABLE FABRIC BACKING

(75) Inventor: Mohammad M Samii, La Jolla, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 80 days.

(21) Appl. No.: 10/262,212

(22) Filed: Sep. 30, 2002

(65) Prior Publication Data

US 2004/0062897 A1 Apr. 1, 2004

(51) Int. Cl.[7] ..... B41F 1/34

(52) U.S. Cl. ..... 101/485; 101/483; 156/152; 156/384

(58) Field of Search ..... 101/212, 216, 101/217, 219, 483, 485, 494; 156/152, 184, 384, 385

(56) References Cited

U.S. PATENT DOCUMENTS 5,174,202 A * 12/1992 Schlichting ..... 101/129
5,410,958 A 5/1995 Sharpe
5,417,785 A 5/1995 Baigas, Jr.
5,698,478 A 12/1997 Yamamoto et al.
6,059,391 A 5/2000 Fulkerson et al.
6,071,368 A * 6/2000 Boyd et al. ..... 156/240
6,156,072 A 12/2000 Usui et al.
6,214,417 B1 4/2001 Watanabe et al.
6,312,123 B1 11/2001 Codos et al.

* cited by examiner

*Primary Examiner*—Ren Yan

(57) ABSTRACT

A system and method for adhering a fabric to a backing substrate is disclosed. The system includes at least one roll of a reusable backing substrate, wherein the reusable backing substrate supports the fabric during a printing process. The system also includes at least one roll of fabric and a lamination system for removably adhering the fabric to the backing substrate. A print zone is configured for receiving the backed fabric and prints a pattern on the backed fabric. After the pattern is printed, the fabric is removed from the backing substrate and the backing substrate may be reused in another printing process. The invention is also directed to a method for printing a pattern on a layer of fabric using a reusable backing substrate and a laminated backing substrate used in the disclosed system and method.

7 Claims, 3 Drawing Sheets

FABRIC PRINTING SYSTEM AND METHOD UTILIZING A REMOVABLE/REUSABLE FABRIC BACKING

FIELD OF THE INVENTION

The present invention generally relates to printing fabric substrates, and more particularly to a printing system that uses a removable backing to support a fabric in a typical digital printing process.

BACKGROUND OF THE INVENTION

In the fabric printing industry, fabrics are typically colored with coloring agents, such as dyes or pigments, using screen printing technology. Most screen printing technologies employ rotary screen printers that use patterns incorporated into fine metal screens that are shaped into cylindrical forms. The coloring agents, in a print paste form, are pumped through tubing into the cylindrical-shaped screens and subsequently transferred to the fabric through the patterned screens by a squeegee that presses the paste through the screens and onto the fabric. After a print run, the rotary screen printer must be shut down to clean the various colors of print paste from the tubing and screens. The cleanup process is time intensive and environmentally unfriendly because a large amount of effluent is required to clean the print paste from the rotary screen printer. In addition to cleaning the rotary screen printer, a cylindrical screen with a different pattern must be inserted into the rotary screen printer to print a different pattern.

To ensure that the pattern printed on the fabric is not distorted, industrial fabric printing machines stretch and glue the fabric to a moving belt that is run through the printing machine. The moving belt is indexed through the printing machine and the various screen stages. Attaching the fabric to the belt prohibits the fabric from moving with respect to the belt and ensures fabric motion control, as well as adequate registration of the fabric such that the fabric moves in a path corresponding to a movement path of the belt. However, gluing the fabric to the belt is an extremely dirty process and creates a large environmentally unfriendly waste stream from the gluing process and the subsequent washing and stripping processes. These inherent problems make industrial fabric printing processes prohibitive to smaller scale users for use in short run fabric printing, such as an office or a store.

To remedy the need for printing processes available on a smaller than industrial scale, ink-jet printing processes for fabrics have been developed. As known to those of ordinary skill in the art, digital printers utilize minute droplets of ink that are injected from nozzles in the ink-jet printer onto a target surface, such as the fabric. In order to produce an image or pattern with a desired sharpness on the fabric, special fabrics, pre-printing processing steps and post-printing processing steps are used to condition and/or chemically or otherwise fix the colorants to the fibers on the fabric. The pre-printing conditioning steps are used to initially condition the humidity and temperature of the fabric to provide an optional ink reception state for the fabric and the post-conditioning steps are used to "fix" the coloring agent to the fabric after the ink has been received by the fabric. The fabric to which the pattern is printed may be backed with a paper layer to reinforce and stabilize the fabric, as well as to produce a barrier to ink blow through. The fabric may also be pre-treated with organic materials in order to increase ink receptivity and reduce the amount of ink spread, which arises from bleeding of the printed ink through fibers in the fabric. As known to those of ordinary skill in the art, the problem of printing on unbacked fabrics using an ink-jet printer is not trivial. The fundamental nature of woven fabrics makes feeding the fabric and printing a pattern on the fabric more complex than ink-jet printing on paper. For instance, fabrics have an almost infinite variation in fabric characteristics due to various factors including, but not limited to, the type of fiber used in the fabric, the fiber weight, the fabric weight, the different blends of materials used in the fiber, the weave pattern used to create the fabric, the environmental conditions existing at the time of printing, the pre-treatments used on the fabric, the surface finish of the fabric, the varying moisture contents of the fiber in the fabric, the non-linear behavior of woven materials, and the difference in fabric behavior between wet and dry fabrics. These factors prohibit the fabrics from moving accurately and uniformly through the printing processes using standard media-moving machines used in ink-jet printers.

In order to stabilize the fabric for passage through an ink-jet printer, the fabric may be laminated to a paper substrate off-line to form a backed fabric. The backed fabric may then be passed through a slightly modified ink-jet printer for the formation of a pattern on the backed fabric. However, the use of off-line paper backings may be costly, time consuming, and may limit the range of fabrics that may be fed through the ink-jet printer. Furthermore, the fabric may be damaged when the fabric is removed from the paper backing. Therefore, a fabric backing system that allows the fabric to pass through an ink-jet printer and produces a printed pattern with a low level of distortion, yet has a low level of damage to the fabric when the fabric is removed from the backing, would be an improvement in the art.

BRIEF SUMMARY OF THE INVENTION

In accordance with the invention, a method for printing a pattern on a layer of fabric removably adhered to a backing substrate is disclosed. The backing substrate comprising a carrier, an adhesive, and a release liner is provided. The release liner is removed from the backing substrate and the layer of fabric is adhered to the adhesive on the backing substrate to form a backed fabric. A pattern is printed on the backed fabric, the fabric is removed from the adhesive on the backing substrate, and the release liner is re-adhered to the adhesive layer of the backing substrate so that the backing substrate can be reused.

A backing substrate for use in a fabric printing process is also disclosed. The backing substrate comprises a carrier, an adhesive, and a release liner. The carrier and the release liner are substantially the same length.

A system for printing a pattern on a backed fabric is also disclosed. The system includes at least one roll of a reusable backing substrate, where the backing substrate is used to support a fabric through a print zone in the printing system. The system also includes at least one roll of fabric. A first roller included in the system is configured to adhere the fabric to the backing substrate to form a backed fabric. The backed fabric is then received by the print zone where a pattern is printed on the backed fabric. The system also comprises at least one device configured to remove the printed fabric from the backing substrate.

BRIEF DESCRIPTION OF THE SEVERAL VIEWS OF THE DRAWINGS

While the specification concludes with claims particularly pointing out and distinctly claiming that which is regarded as the present invention, the present invention can be more readily ascertained from the following description of the invention when read in conjunction with the accompanying drawings in which:

DETAILED DESCRIPTION OF THE INVENTION

The invention described herein is directed to a fabric lamination system for use with fabric printing processes that use ink-jet printers or other printing devices that transmit ink through the air to the fabric. More specifically, a system that uses an easily removable backing that may be temporarily adhered to a fabric to support the fabric during passage through a print zone is disclosed. The system enables a user to support a fabric with a backing, print a pattern on the backed fabric with an ink-jet printer, and prevent the printed image from being distorted on the fabric. As used herein, the term "pattern" refers to any type of design, mark, figure, identification code, graphic, work, image, or the like which may printed.

Figure 1A:
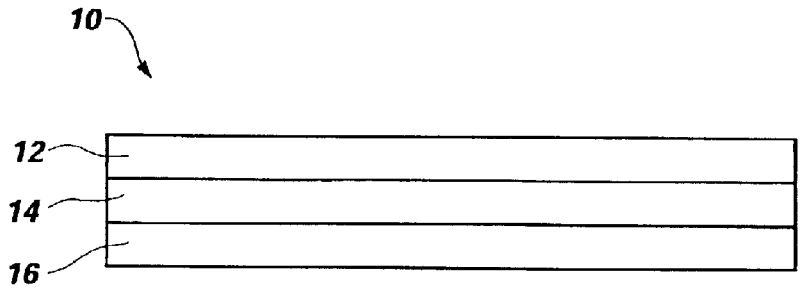
FIG. 1A represents a cross-section of a backing substrate used in an embodiment of the present invention.

It will be apparent from the following description that the drawings described herein used to represent various features of the present invention are not drawn to scale, but are rather for illustrative and exemplary purposes only. Referring now to drawing FIG. 1A, there is shown a cross-section of a backing substrate (hereinafter "substrate 10") used in the present invention. As illustrated in FIG. 1A, the substrate 10 comprises three layers including a release liner 12, a layer of low tack or similar adhesive 14, and a carrier substrate 16 (hereinafter "carrier").

In the illustrated embodiment, the release liner 12 comprises a wax release liner, but other release liners that perform functions the same as, or equivalent to, the wax release liner 12 described herein are meant to be encompassed by the present invention. Other non-stick materials that may be used in the release liner 12 include, without limitation, TEFLON® brand non-stick coating (available from the E. I. DuPont de Nemours Company, of Wilmington, Del.), silicon, polyester, cellophane, nylon, various other plastic materials, or any other non-stick material known to those of ordinary skill in the art. In the illustrated embodiment, the release liner 12 is releasably adhered to the adhesive 14 and functions to prevent the various layers of the substrate 10 from becoming permanently adhered together when the substrate 10 is rolled on a roll (shown in FIG. 2).

The adhesive 14 in the illustrated embodiment comprises a low tack adhesive, such as the adhesive used on Post-it® notes (available from the 3M Company, of St. Paul, Minn.). It will be apparent that any solvent-based low tack adhesive known to those of ordinary skill in the art that may be used to temporarily adhere one surface to another surface may be used for the adhesive 14 of the present invention. Other low-tack adhesives that may be used include, without limitation, rubber cement, adhesives used in transparent cellophane adhesive tapes, such as Scotch® tape, or 3M brand Spray Mount®) Artist's Adhesive (both available from the 3M Company, of St. Paul, Minn.). As illustrated, the adhesive 14 is disposed on the carrier 16 such that the adhesive 14 remains adhered to the carrier 16 at all times through the printing processes. Although the carrier 16 used in the illustrated embodiment comprises a paper carrier 16, it will be apparent that any carrier substrate that performs functions the same as, or similar to, the carrier 16 described herein may be used.

Figure 1B:
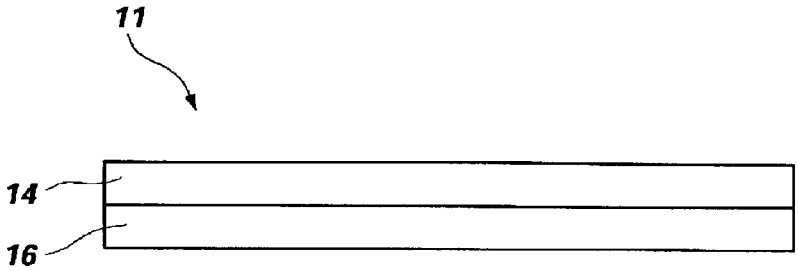
FIG. 1B represents a cross-section of the backing substrate of FIG. 1A in an embodiment of the present invention, where a release liner of the backing substrate has been removed.

Referring now to drawing FIG. 1B, there is shown a cross section of a delaminated substrate generally at 11. As illustrated, the delaminated substrate 11 comprises the substrate 10 of FIG. 1A with the release liner 12 removed, where the adhesive 14 remains disposed on the carrier 16. Since the release liner 12 is a wax release liner in the illustrated embodiment and is removably adhered to the adhesive 14, the release liner 12 may be easily separated from the adhesive 14 while the adhesive 14 remains adhered to the carrier 16.

Figure 1C:
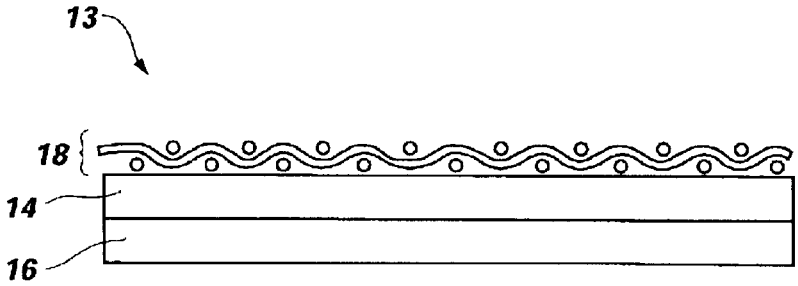
FIG. 1C represents a cross-section of the backing substrate of FIG. 1B in an embodiment of the present invention, where a fabric has been adhered to the backing substrate.

Referring now to drawing FIG. 1C, there is shown a cross-section of a backed fabric generally at 13. As illustrated, the backed fabric 13 has a layer of fabric 18 removably adhered to the adhesive 14. It will be appreciated that any type of fabric known to those of ordinary skill in the art may be adhered to the adhesive 14 and passed through the printing process of the present invention. It will be further appreciated that materials besides fabric may be used in the embodiments of the present invention, such as other gray goods, wallpapers, or other fabric like materials known to those of ordinary skill in the art. As illustrated, the carrier 16 provides support to the fabric 18 during the printing process, as will be described in further detail below. However, in a manner similar to the release liner 12, the fabric 18 is not permanently adhered to the adhesive 14, but may be subsequently removed from the adhesive 14 without damaging the fabric 18 using substantially small delamination forces.

Referring now to drawing FIG. 2, there is shown a diagrammatic representation of a lamination and tension control system (hereinafter "lamination system") used in conjunction with the printing process of the present invention generally at 20. The lamination system 20 includes a plurality of driven and idler rollers that function in concert to carry, decrease, stick, laminate and support the fabric 18, the substrate 10, the delaminated substrate 11, and the backed fabric 13 for passage and transport through the lamination system 20. Although not illustrated, the lamination system 20 also includes at least one drive gear, or other drive mechanism known to those of ordinary skill in the art, operably connected to at least one idler, drum, or roller of the lamination system 20 in order to impart movement, at least in part, to the various moving elements of the lamination system 20. The lamination system 20 described herein adheres the fabric 18 to the delaminated substrate 11 as illustrated in FIG. 1C and prints a pattern on the backed fabric 13 using a printing process, such as a digital printing system.

The lamination system 20 begins the printing process by unwinding, or unrolling, a fabric supply roll 22 and a substrate roll 24. As used herein, the terms "unwinding" and "unrolling" may be used synonymously. As the printing process proceeds, the release liner 12 is peeled away from the adhesive 14 by a peel roller 26. As used herein, the term "peel roller" will be used to refer to a device or roller that functions to remove the release liner 12 from the substrate 10 and is meant to include any device known to those of ordinary skill in the art that performs such a function. As illustrated, once the release liner 12 is removed from the substrate 10, the release liner 12 follows a path through the lamination system 20 as represented by a dashed line and moves in a direction indicated by arrows 28. The delaminated substrate 11, comprising the carrier 16 and the adhesive 14, follows a path through the lamination system 20, where the delaminated substrate 11 path is represented by a solid line and moves in a direction indicated by arrows 30. The substrate roll 24 unwinds in a direction of arrow 34 as the printing process proceeds. The arrows depicted on rollers in the drawings indicate the direction in which the various rollers or idlers rotate. The delaminated substrate 11 is supported by idler wheels 32 (hereinafter "idler") along the delaminated substrate 11 path. The fabric supply roll 22 also unwinds and the path that the fabric 18 follows through the lamination system 20, or the fabric 18 path, is indicated by a solid line and arrows 36. As illustrated, the fabric 18 and substrate 10 described herein comprise sheets that are longer in length than in width, such that the fabric 18 and the substrate 10 are supplied in rolls as described herein.

After the fabric 18 is unwound from the fabric supply roller 22, the fabric 18 is conditioned for printing by running the fabric 18 through a tension control and crease control system (hereinafter "conditioning system"). As used herein, the term "conditioning" will be used to refer to any treatment performed on the fabric 18 before the fabric 18 has a pattern printed thereon, including, but not limited to, smoothing the fabric 18 by ironing or steaming, applying tension to the fabric, treating the fabric such that coloring agents adhere more efficiently to the fabric 18, or any other conditioning treatment used on fabrics in a printing process as known to those of ordinary skill in the art. Since the unwound fabric 18 may have various creases and irregularities present, the fabric 18 is conditioned to remove any creases or irregularities.

As illustrated, the conditioning system comprises a first cross-web stretch roller 38, which as known to those of ordinary skill in the art may be used to take creases out of the fabric 18 and provide a light cross-web tension to the fabric 18. After passage through the first stretch cross-web roller 38, the fabric 18 is passed through a bowed roller 40 that is powered by a bow roller drive motor 41. The bowed roller 40 is used to further prepare the fabric 18 for printing and may further smooth the fabric 18 by removing other creases or irregularities not removed by the cross-web stretch roller 38. After leaving the bowed roller 40, the fabric 18 continues along the fabric 18 path indicated by arrows 36 through a second cross-web stretch roller and a tension along-web tensioning roller (hereinafter "tension system") collectively illustrated as the tension system 39. The tension system 39 stretches the fabric 18 to the proper cross/along web-tension for the subsequent printing process. The fabric 18 is then passed under a fabric tension sensor 44, which may comprise a charge-coupled device (CCD) sensor array with a low incident angle illumination light source. The fabric tension sensor 44 may also detect any other surface irregularities, such as a knot, in the fabric 18. If any knots or irregularities are detected, the fabric tension sensor 44 may direct the printing system to raise the printing components used to print the pattern or lower the fabric in an effort to ensure that the components are not damaged by the knot or other hard irregularity within the fabric 18.

Alternatively, if the fabric tension sensor 44 detects irregularities or deformities in the fabric 18 that may cause the printed pattern to be distorted or irregular on the fabric 18, the fabric tension sensor 44 may direct the printing system to mark the irregular area on the fabric 18 such that distorted or irregular areas in the finished product may be designated as such and easily detected. Although the conditioning system in the illustrated embodiment has been described as including stretch rollers 38, the bowed roller 40, the tension system 39, and the tension sensor 44, any other devices or methods known to those of ordinary skill in the art used for conditioning fabric 18 for printing are meant to be encompassed by the present invention. Although not illustrated, the lamination system 20 may also include a second array of sensors for detecting additional irregularities, such as knots and creases. Other devices that may be used in conjunction with or in place of the conditioning system described herein include, without limitation, ironing systems, steaming systems, and/or skewed rollers.

Once the fabric 18 is conditioned, the fabric 18 is removably adhered to the adhesive 14 on the delaminated substrate 11 by a pressure roller 46. As illustrated in FIG. 2, the pressure roller 46 and a large radius drum 52 come in contact at a nib, shown generally at arrow 15, where the fabric 18 and the delaminated substrate 11 come in contact from their respective paths. As illustrated, the pressure roller 46 comprises an idler roller that is adjustable to vary the space between the pressure roller 46 and the large radius drum 52. The adjustable space allows for various fabric 18 thicknesses to be rolled between the pressure roller 46 and the large radius drum 52. The pressure roller 46 provides a lamination force that adheres the fabric 18 to the adhesive 14 on the delaminated substrate 11 to produce the backed fabric 13. Although the pressure roller 46 has been described in the illustrated embodiment, it will be appreciated that any other device that provides a lamination force to cause fabric 18 to adhere to the adhesive 14 on the delaminated substrate 11 may be used in the present invention. The large radius drum 52 comprises a large radius roller with a rough surface that receives the backed fabric 13. As known to those of ordinary skill in the art, the rough surface on the large radius drum 52 prevents the backed fabric 13 from moving or slipping on the surface of the large radius drum 52.

The lamination system 20 may also include a brush (not illustrated) positioned after the pressure roller 46 in the fabric path at arrow 31. The brush may be used to further condition the backed fabric 13 uniformly and avoid pressure artifacts in the backed fabric 13. It will be apparent to those of ordinary skill in the art that the conditioning system is important to ensure that the fabric 18 is smooth before being adhered to the delaminated substrate 11, because once the fabric 18 is laid out and adhered to the delaminated substrate 11, the backed fabric 13 will remain in the same condition throughout the printing process. Thus, since the adhesive 14 on the delaminated substrate 11 temporarily holds the fabric 18 in position for printing, any irregularity present on the surface of the fabric 18 when the fabric 18 is laid out on the delaminated substrate 11 may cause a distorted pattern to be printed on the backed fabric 13.

After the fabric 18 is adhered to the delaminated substrate 11, a motion-sensing device 48 is used to sense the motion of the backed fabric 13 as the backed fabric 13 enters the print zone 50. In the illustrated embodiment, the motion-sensing device 48 comprises a navigation sensor system (as described in U.S. Pat. No. 6,195,475, "Navigation System for Handheld Scanner", Beausoleil and Allen, assigned to Hewlett-Packard Company) that uses low angle lighting to create high contrast shadow patterns on a surface of the backed fabric 13, where a CCD array of the navigation sensor system captures images of the backed fabric 13. Using electronics and software of the navigation sensor system, the axis motion of the backed fabric 13 may be controlled in order to minimize banding and other backed fabric 13 motion variables in order to minimize distortion and irregular printing patterns on the backed fabric 13 during the printing process.

Once the backed fabric 13 passes the motion sensing device 48, the backed fabric 13 enters the print zone 50. In the illustrated embodiment, the print zone 50 comprises the large radius drum 52 and an ink-jet printer that functions to print a pattern on a surface 54 of the backed fabric 13 that is located within the print zone 50. As used herein, the term "ink-jet printer" will be used to refer to any electromechanical device adapted to deposit ink onto a fabric. As the backed fabric 13 passes through the print zone 50, the backed fabric 13 is supported by the large radius drum 52 which is designed to function in concert with other components within the print zone 50 to securely hold and accurately advance the backed fabric 13 in a stable state throughout the print zone 50. Also, since the backed fabric 13 is adhered to the delaminated substrate 11, the backed fabric 13 is prevented from slipping on the delaminated substrate 11 and prevents a distorted pattern from being printed on the backed fabric 13. Furthermore, since the surface of the large radius drum 52 is roughened, the backed fabric 13 is prevented from slipping. It will be apparent to those of ordinary skill in the art that the ink-jet printer in the print zone 50 may be configured to communicate with the motion sensing device 48 and the tension sensor 44 such that the ink-jet printer may be adjusted during the printing process to incorporate data gathered from the motion sensing device 48 and/or the tension sensor 44. For instance, if an irregularity is detected in the backed fabric 13, components within the print zone 50 may be used to raise print heads located within the ink-jet printer or lower the large radius drum 52 to prevent the print heads from being damaged by the irregularity, such as a crease or knot. Alternatively, the motion-sensing device 48 may be used to help ensure the print quality of the image printed on the backed fabric 13 is achieved.

Once the pattern has been printed on the backed fabric 13, the fabric 18 is removed from the adhesive 14 on the delaminated substrate 11. As previously described herein, because the adhesive 14 comprises a low tack adhesive, the fabric 18 may be removed from the delaminated substrate 11 without damaging the fabric 18. An idler 32 located on the left side of the drawing FIG. 2 supports the fabric 18. A reattach roller 53 supports the delaminated substrate 11. As illustrated, the fabric 18 follows the fabric path indicated by arrows 36 and the delaminated substrate 11 follows the substrate path indicated by arrows 30. The diversion of the fabric 18 and the delaminated substrate 11 to different paths and the motion of the rolls provide the force required to remove the fabric 18 from the delaminated substrate 11. The fabric 18 also passes through or near a dryer 56 such that ink from the ink-jet printer may be dried, or fixed, on the fabric 18. The dry fabric 18 continues on the fabric 18 path over the idler 32 and is wound on a fabric take-up roll 58. The delaminated substrate 11 follows the unbaked substrate path 30 to the reattach roller 53, and where the reattach roller 53 provides pressure against the idler roller 32, or at the nib, the delaminated substrate 11 is brought into contact with and adhered to the release liner 12. As illustrated, after the release liner 12 is separated from the substrate 10, the release liner 12 follows the release liner path indicated by the dashed line and arrows 28 such that the release liner 12 is brought back into contact with the delaminated substrate 11 at the reattach roller 53. The reattach roller 53 then re-adheres the release liner 12 to the adhesive 14 on the delaminated substrate 11, and the substrate 10, with the release liner 12 reattached is wound on a roll 60. It will be apparent that the release liner 12 adhered on the substrate 10 may then be reused in a subsequent printing process for cost savings to the user. The substrate 10 is rolled on the roll 60 in the opposite direction that the substrate 10 is unwound from the substrate roll 24. Thus, it will be apparent to those of ordinary skill that the substrate 10 on the roll 60 must either be rewound in the opposite direction for re-use on the substrate roll 24 or the roll 60 must be flipped around so that the substrate 10 may be unwound from the roll 60 during a subsequent printing process.

In the present embodiment, it will be further apparent that the various rolling and unrolling of the fabric 18 on the rolls 22 and 58 and the substrate 10 on rolls 24 and 60 during the printing process occur simultaneously and the speed of the rolling and unrolling may be controlled by a closed loop servo system (not illustrated) that uses encoders that are substantially similar to motion control systems as is known to those of ordinary skill in the art. In operation of the printing system, the substrate 10 will have the release liner 12 adhered to the adhesive 14 on the rolls 24 and 60, but the release liner 12 will not be adhered to the delaminated substrate 11 as the delaminated substrate 11 passes through the print zone 50. Rather, the fabric 18 will be adhered to the adhesive 14 on the delaminated substrate 11 as the backed fabric 13 passes through the print zone 50.

Figure 2:
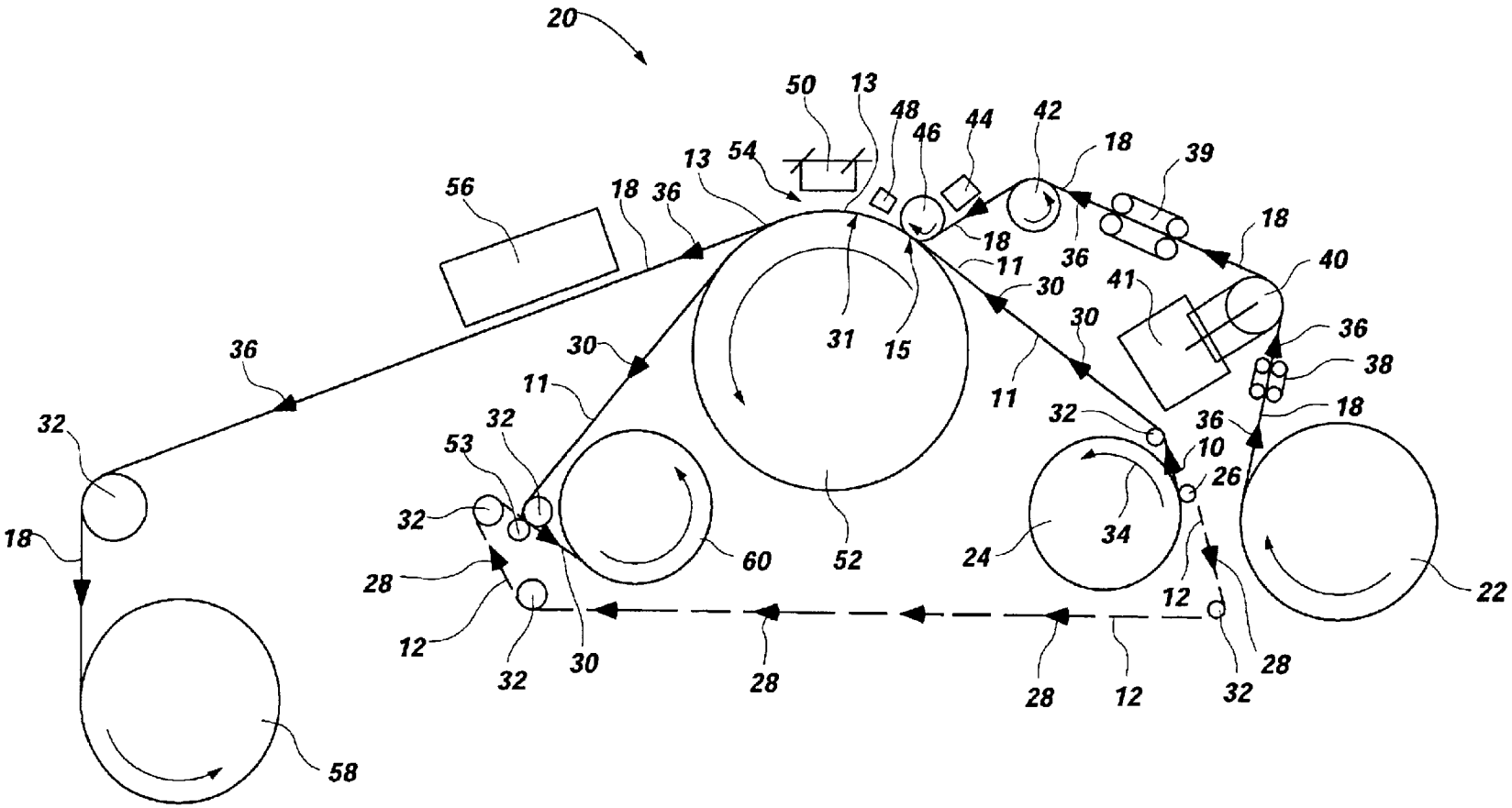
FIG. 2 represents a diagrammatic representation of the basic architecture and workings of a fabric lamination system used in an embodiment of the present invention.
Figure 3:
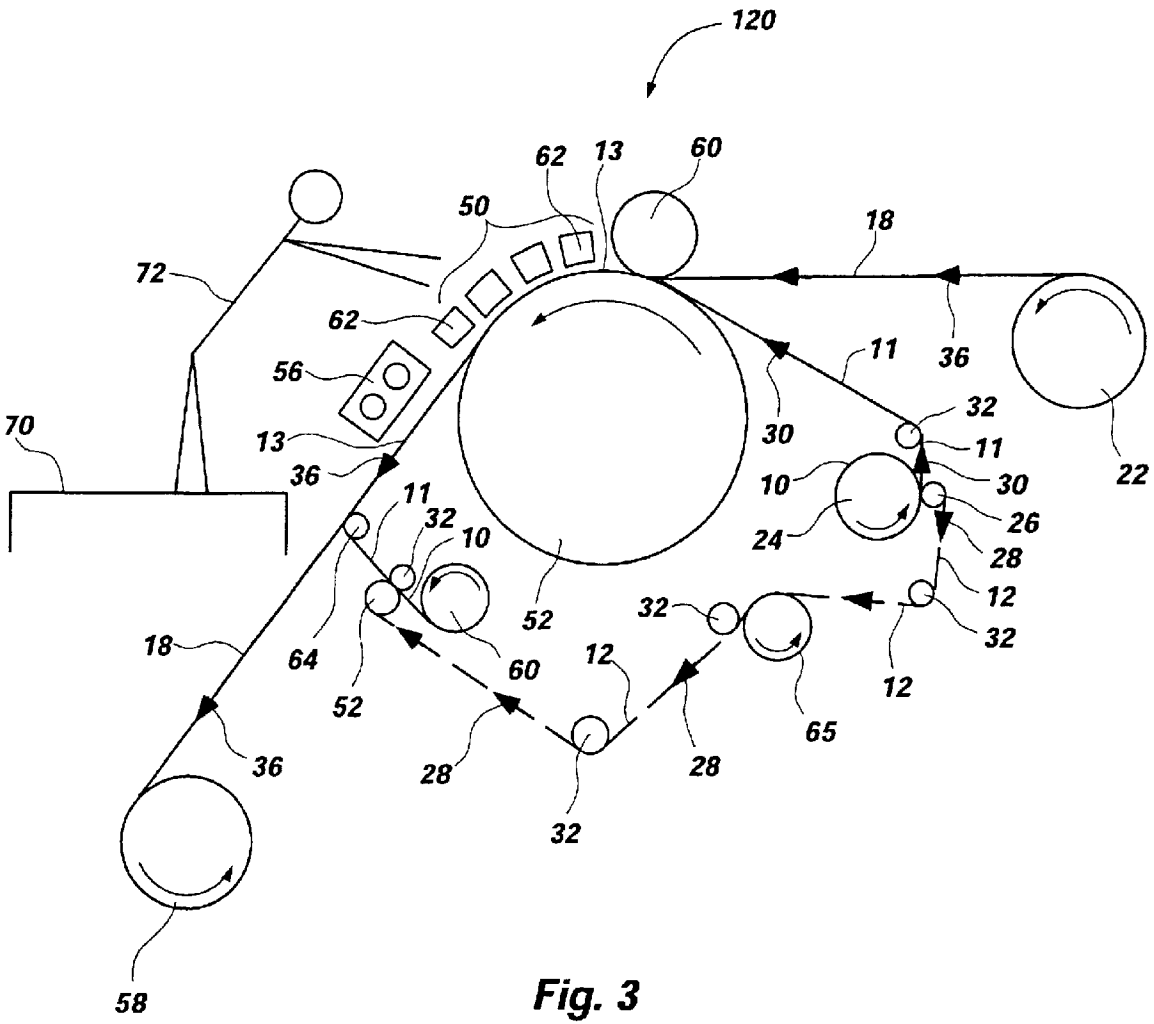
FIG. 3 represents an alternative embodiment of the basic architecture and workings of the fabric lamination system of the present invention.

Referring now to drawing FIG. 3 there is shown an alternative embodiment of the lamination system of the present invention generally at 120. The lamination system 120 of the alternative embodiment includes a fabric supply roll 22, where fabric 18 is unwound off the fabric supply roll 22 and travels in a fabric 18 path indicated by a solid line and arrows 36. The lamination system 120 also uses the substrate 10 of FIG. 1A. As illustrated, a substrate roll 24 is unwound such that a release liner 12 is removed from the substrate 10 by a peel roller 26 to result in the delaminated substrate 11. As illustrated, the delaminated substrate 11 follows a delaminated substrate path illustrated by a solid line and arrows 30 and the release liner 12 follows a release liner 12 path indicated by a dashed line and arrows 28. As illustrated, the fabric 18 is adhered to the delaminated substrate 11 by a pinch roller 60 that provides a force to adhere the fabric 18 to the adhesive 14 of the delaminated substrate 11 to form a backed fabric 13. Although not illustrated, it will be apparent to those of ordinary skill in the art that the various conditioning systems described herein with reference to FIG. 2 may also be incorporated into the lamination system of FIG. 3 and not depart from the spirit of the present invention.

After the fabric 18 is adhered to the delaminated substrate 11, the backed fabric 13 travels through a print zone 50, which is depicted in the illustrated embodiment as including four print bars 62. As the backed fabric 13 passes through the print zone 50, the backed fabric 13 is supported by a large radius drum 52 which is designed to function in concert with other components within the print zone 50 to hold and advance the backed fabric 13 in a stable state throughout the print zone 50, in a similar manner as described herein with reference to drawing FIG. 2. As known to those of ordinary skill in the art, print bars 62 typically span a width of the media on which a pattern is to be printed. As illustrated, the print bars 62 are stationary in the print zone 50 wherein the backed fabric 13 is moved under the print bars 62 such that printing may take place. As known to those of ordinary skill in the art, each color used for printing has its own print bar 62. Therefore, the number of print bars 62 used may vary depending on the number of colors used to produce the pattern on the backed fabric 13.

Once the backed fabric 13 has the pattern printed thereon, the backed fabric 13 passes under or near a dryer 56 to dry, or cure, the ink on the backed fabric 13. As illustrated, the fabric 18 is separated from the adhesive 14 on the delaminated substrate 11 by a separation roller 64. It will be apparent that the separation roller 64 acts in a manner similar to the peel roller 26 described herein with reference to drawing FIG. 2. As previously described herein, since the backed fabric 13 is adhered to the low-tack adhesive 14, the fabric 18 may be removed from the adhesive 14 without damaging the fabric 18. After the fabric 18 is separated from the delaminated substrate 11, the fabric 18 is collected on a fabric take-up roll 58. The delaminated substrate 11 is directed to a reattach roller 52 where the release liner 12 is re-adhered to the adhesive 14 on the delaminated substrate 11 and taken up by a roll 60.

The lamination system 120 also includes a platform 70 where a user 72 of the lamination system 120 may be located to tend to and operate the lamination and printing system 120. The user 72 may make various adjustments to the lamination system 120 during the printing process by visualizing the pattern printed on the backed fabric 13 to ensure that the printed pattern is not distorted. The illustrated lamination system 120 of drawing FIG. 3 would be more economical to manufacture than the lamination system 20 depicted in drawing FIG. 2 since there are fewer components and may be more suited to the production of short-run fabrics or fabric samples for the testing and evaluation of various printed patterns and fabrics.

Although the illustrated embodiments of drawings FIG. 2 and FIG. 3 show the release liner 12 being reused and reattached to the delaminated substrate 11, it will apparent to those of ordinary skill in the art that the delaminated substrate 11 and/or the release liner 12 may be discarded instead of re-used. For instance, if the substrate 10 has been used multiple times in the printing process, becomes excessively worn, loaded with loose fibers, soiled, or is damaged, the substrate 10 may be replaced. For instance, during operation, the substrate 10 may become excessively soiled with ink from the printing process or the adhesive 14 may become excessively coated with fibers that are shed off of the fabric 18. For example, a loosely knit fabric or loose wound fibers may readily shed fibers that adhere to the adhesive 14, making the adhesive 14 in the substrate 10 unsuitable for further use. However, if a tightly knit fabric (e.g., denim) is used, the adhesive 14 may have a minimal amount of fibers retained, thus lengthening the life of the adhesive 14, and thus the substrate 10. As shown in drawing FIG. 3, a take up reel 65 may be used to roll the release liner 12 instead of the release liner 12 traveling along the path indicated by the solid line and arrows 28 and being re-adhered to the substrate 10. If the release liner 12 is taken up by the take up reel 65, then the substrate 10 may be rolled on the roll 60 and discarded instead of being reused.

Although the present invention has been shown and described with respect to various illustrated embodiments, various additions, deletions and modifications that are obvious to a person of ordinary skill in the art to which the invention pertains, even if not shown or specifically described herein, are deemed to lie within the scope of the invention as encompassed by the following claims.

What is claimed is:

1. A method for printing a pattern on a fabric, comprising: providing a backing substrate comprising a release liner removably adhered to an adhesive, wherein said adhesive is disposed on a carrier; removing said release liner from said adhesive; adhering a fabric to at least a portion of said adhesive disposed on said carrier to form a backed fabric; printing a pattern on said backed fabric; removing said fabric from said portion of said adhesive disposed on said carrier; and re-adhering said release liner to said adhesive disposed on said carrier.

2. The method according to claim 1, further comprising: providing said backing substrate on a first roll; unrolling said first roll of said backing substrate; and re-rolling said backing substrate on a second roll.

3. The method according to claim 1, wherein removing said release liner from said adhesive, adhering said fabric to said at least portion of said adhesive, printing said pattern on said backed fabric, removing said fabric from said portion of said adhesive, and re-adhering said release liner to said adhesive occur simultaneously.

4. The method according to claim 1, wherein adhering said fabric to said adhesive comprises: providing a roller and a large radius drum; and rolling said fabric and said backing substrate between said roller and said large radius drum.

5. The method according to claim 1, further comprising conditioning said fabric before said fabric is adhered to said portion of said adhesive.

6. The method according to claim 1, wherein printing said pattern on said backed fabric comprises passing said backed fabric through a print zone comprising at least one ink-jet printer.

7. The method according to claim 1, wherein removing said release liner from said backing substrate comprises: providing a peel roller; and passing said backing substrate over said peel roller to remove said release liner from said backing substrate.

* * * * *